United States Patent [19]

Diggle, Jr.

[11] Patent Number: 4,598,444

[45] Date of Patent: Jul. 8, 1986

[54] SPREADER-PROPELLER APPARATUS FOR TUBULAR KNITTED FABRIC

[75] Inventor: Edmund A. Diggle, Jr., Oradell, N.J.

[73] Assignee: Samcoe Holding Corporation, Woodside, N.Y.

[21] Appl. No.: 652,321

[22] Filed: Sep. 19, 1984

[51] Int. Cl.[4] ..... D06C 5/00

[52] U.S. Cl. ..... 26/84

[58] Field of Search ..... 26/80, 83, 84

[56] References Cited

U.S. PATENT DOCUMENTS

| | | | |
|---|---|---|---|
| 2,189,166 | 2/1940 | Cohn et al. | 26/83 X |
| 2,507,599 | 5/1950 | Johnson . | |
| 2,623,263 | 12/1952 | Dungler . | |
| 3,695,062 | 10/1972 | Schaack . | |
| 3,922,765 | 12/1975 | Hogendyk . | |
| 3,955,251 | 5/1976 | Hogendyk . | |
| 3,978,557 | 9/1976 | Goodson . | |
| 4,306,340 | 12/1981 | Strudel et al. . | |

FOREIGN PATENT DOCUMENTS

| | | | |
|---|---|---|---|
| 41-9158 | 5/1966 | Japan | 26/83 |

*Primary Examiner*—Robert R. Mackey

*Attorney, Agent, or Firm*—Mandeville and Schweitzer

[57] ABSTRACT

A propeller-spreader for tubular knitted fabric is disclosed, in which internal, fabric edge engaging propeller belts are driven by means of magnetic coupling with internal, magnetic drive sheaves. A spreader frame, of flat configuration, arranged to laterally distend tubular knitted fabric to flat, two-layer form, is supported by means of a pair of spaced, transversely extending rollers. Magnetically coupled drive elements are positioned between the transverse support rollers and are driven to rotate in synchronism with the rotations of the support rollers. Ideally, the spreader frame is supported and positioned exclusively by means of the transverse support rollers, in conjunction with the magnetic attraction of the magnetically coupled drive means.

10 Claims, 7 Drawing Figures

FIG. 1
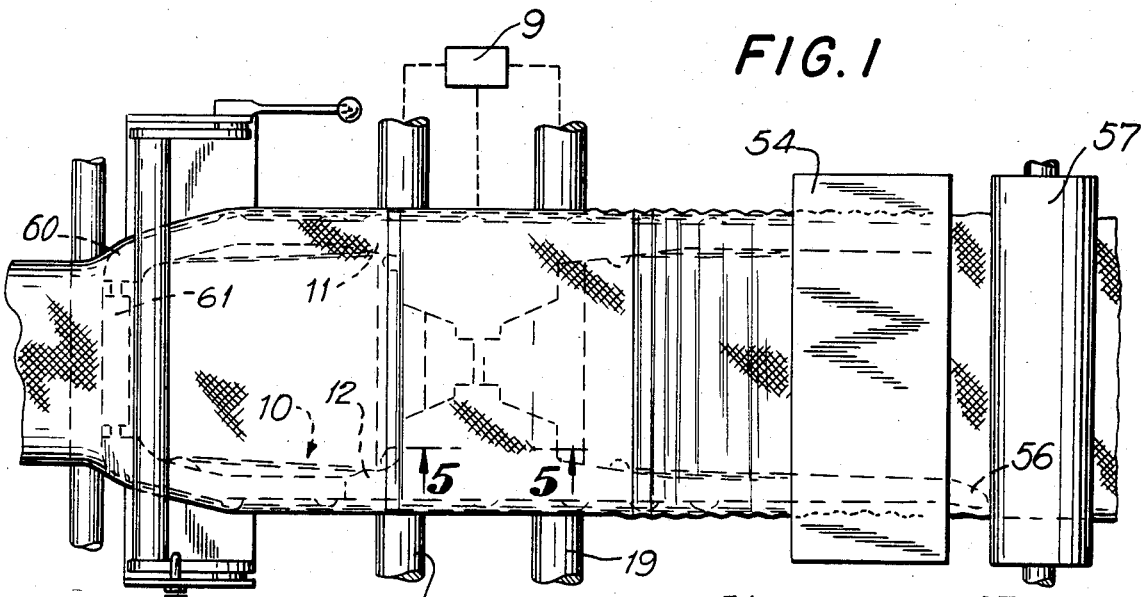
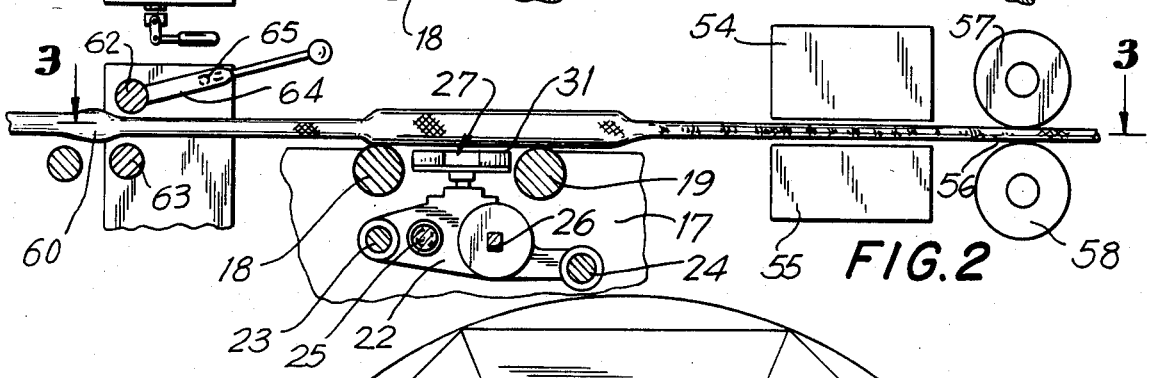
FIG. 2
FIG. 7
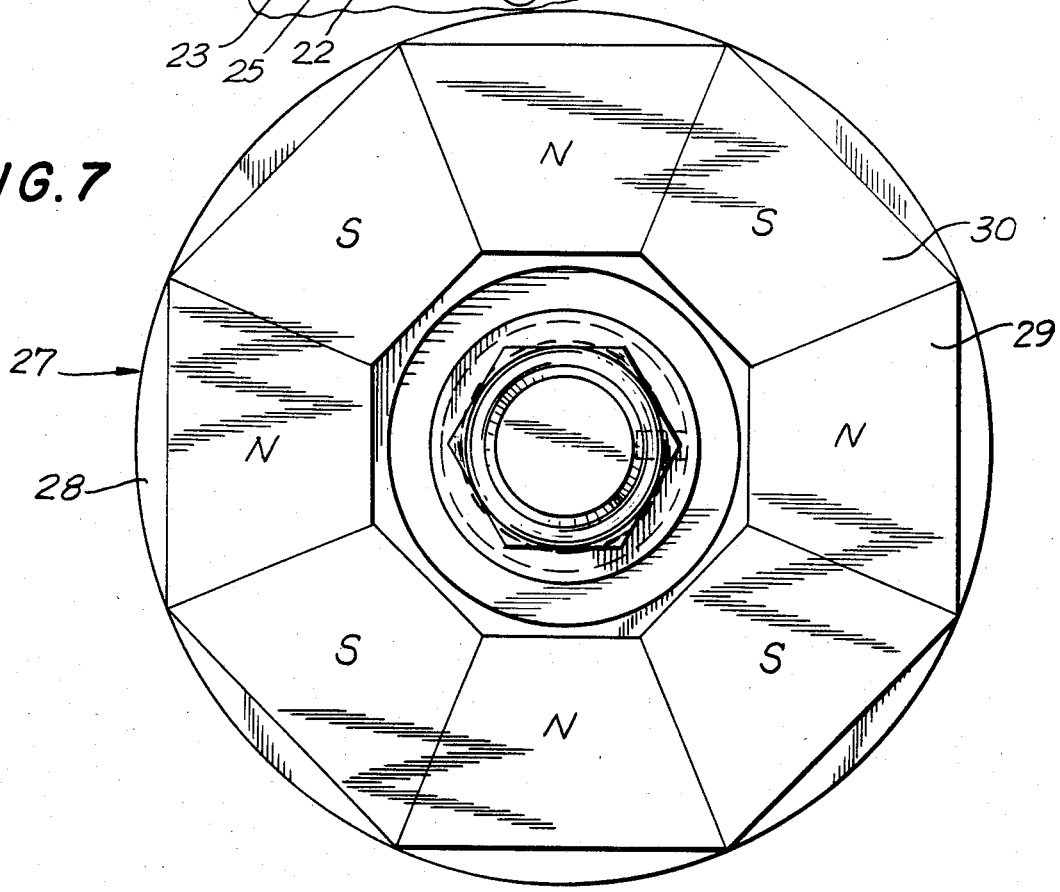

F
47
53
34
33
51
48
52
99
50
24
26
22
25
23
27
28
29,30
7
7
39
21
50
48
34
33
43
44
45
35
38
36,37
32
40
41
42
21

SPREADER-PROPELLER APPARATUS FOR TUBULAR KNITTED FABRIC

BACKGROUND AND SUMMARY OF THE INVENTION

In the processing of tubular knitted fabrics, it is conventional to perform a number of operations, such as washing, bleaching, dyeing, etc. with the fabric in the form of an elongated tubular web. Knitted fabric has notoriously poor geometric stability, particularly when wet, and thus typically becomes considerably elongated and correspondingly reduced in width during the various processing operations that are normally required. Accordingly, as one of the normal finishing operations, it is typical at one or more stages to cause the tubular fabric to be advanced over a spreader device, which distends the fabric laterally to a predetermined width, ideally close to the "natural" width of the knitted fabric. While thus laterally distended, the fabric may be moistened by steaming and then calendered by opposed pressure rolls. In some cases, the fabric at this stage may be subjected to mechanical compressive preshrinkage operations. Representative forms of such spreader devices are disclosed in, for example, the Andrew P. Cecere U.S. Pat. No. 4,173,812 and/or the Robert Frezza U.S. Pat. No. 4,192,045, both assigned to Samcoe Holding Corporation. These and many other forms of spreader devices for tubular knitted fabric utilize a pair of opposed edge drive rolls, which engage the opposite sides of the spreader device. The tubular fabric, passing over the spreader, is gripped between the side edges of the spreader frame and the opposed edge drive rolls. In most cases, the spreader is provided with internal propeller belts, which engage the fabric tube by its internal edges and convey it forwardly. These belts are driven indirectly by the externally driven edge drive rolls, which press through the fabric edges and drive internal belt pulleys frictionally, through the intervening fabric wall.

Propeller-spreader mechanisms of the type generally described above have been widely and successfully used for many years. Nevertheless, with respect to certain especially "sensitive" fabrics, particularly those designed for outerwear garments, the pressure of the edge rolls on the fabric, where the spreader frame is supported by the edge rolls and the internal belts are engaged and driven, is enough to mark the fabric and reduce its quality and its ultimate saleability.

Numerous efforts have been made in the past to construct the spreader apparatus in such manner as to enable the internal belts of the spreader to be properly driven, while at the same time minimizing the tendency of the equipment to mark the processed fabric, particularly the more sensitive, darker shades of outerwear fabric. A theoretically interesting approach to this end is reflected in the Johnson U.S. Pat. No. 2,507,599, in which provision was made for magnetically coupling an internal belt drive mechanism of a spreader apparatus to a magnetic external drive arrangement. Theoretically, at least, this enabled the internal fabric-engaging belts to be driven without the necessity of establishing driving contact through the fabric wall. The apparatus of the Johnson patent nevertheless utilized edge rolls, much in the nature of conventional, externally driven edge drive rolls, for supporting the spreader frame by its edges, and inherently imposing some degree of concentrated pressure at the fabric edges, carrying the possibility of edge marking. Insofar as the applicant is aware, the mechanism of the Johnson patent did not achieve commercial success. The Hogendyk U.S. Pat. No. 3,955,251 employed magnetic devices as the principal means of positioning the spreader. No internal drive means were provided for, however.

In accordance with the present invention, a novel and greatly improved form of spreader-propeller apparatus is provided, which utilizes certain of the basic concepts illustrated in the before mentioned Johnson patent, for the driving of internal spreader belts by means of magnetic coupling, but which constitutes a significant improvement over the prior art apparatus in respect of its ability to deliver processed fabric free of undesirable marking. To this end, magnetically coupled, external drive means are provided, normally positioned on one side of the spreader frame, directly opposite and cooperatively coupled with magnetic internal drive pulleys for the spreader frame internal belts. In accordance with one aspect of the invention, the spreader frame support structure includes a pair of transverse support rollers, typically full width, arranged in straddling relation to the external magnetic drive elements. These across-the-width support rollers define a common plane spaced just slightly above the upper surfaces of the magnetic drive elements and provide for the central support of the spreader frame with the internal belt-driving discs in closely spaced, magnetically coupled relation to the external drive discs. The spaced support rollers are driven in synchronism with the external drive discs such that, when fabric is being advanced over the spreader, it is essentially not affected by the support rollers. Further, the support rollers are arranged to engage the fabric over a broad, flat surface, rather than at its edges, making it possible to spread the supporting force over a relatively great area, so as to maintain unit pressures at a practical minimum. Additionally, supporting the spread fabric across one of its broad faces, avoids problems, inherent at the edges, arising from the fact that the fabric does not present a flat surface in the edge regions. As a result, it is more difficult to avoid high unit pressure at the edges, and it may also be difficult to avoid some rubbing of the fabric. The use of grooved rolls, for example, at the edges results in different surface areas of the grooved rolls having different surface speeds, such that not all portions of the grooved rolls can be maintained in non-slipping contact with a curved edge surface of the fabric.

In accordance with another aspect of the invention, the propeller-spreader apparatus, supported by across-the-width, driven rollers, may be positioned effectively in the upstream-downstream directions, and also in the width directions, exclusively by means of the magnetic coupling elements, without requiring addition rollers or other positioning means to make physical engagement with the spreader apparatus. Further, in this respect, under certain conditions, it is possible to utilize the magnetic coupling effect of the external magnetic drives to effect width adjustment of the spreader apparatus, although for most fabrics it is necessary or desirable to provide for more positive width setting of the spreader frame.

For a more complete understanding of the invention, and a more detailed description of the above and other features and advantages thereof, reference should be made to the following detailed description of a preferred embodiment and to the accompanying drawings.

DESCRIPTION OF THE DRAWING

FIG. 1 is a top plan view illustrating a processing apparatus incorporating features of the invention.

FIG. 2 is a fragmentary side elevation of the apparatus of FIG. 1.

FIG. 7 is an enlarged, cross sectional view as taken generally on line 7—7 of FIG. 5.

DESCRIPTION OF A PREFERRED EMBODIMENT OF THE INVENTION

Figure 3:
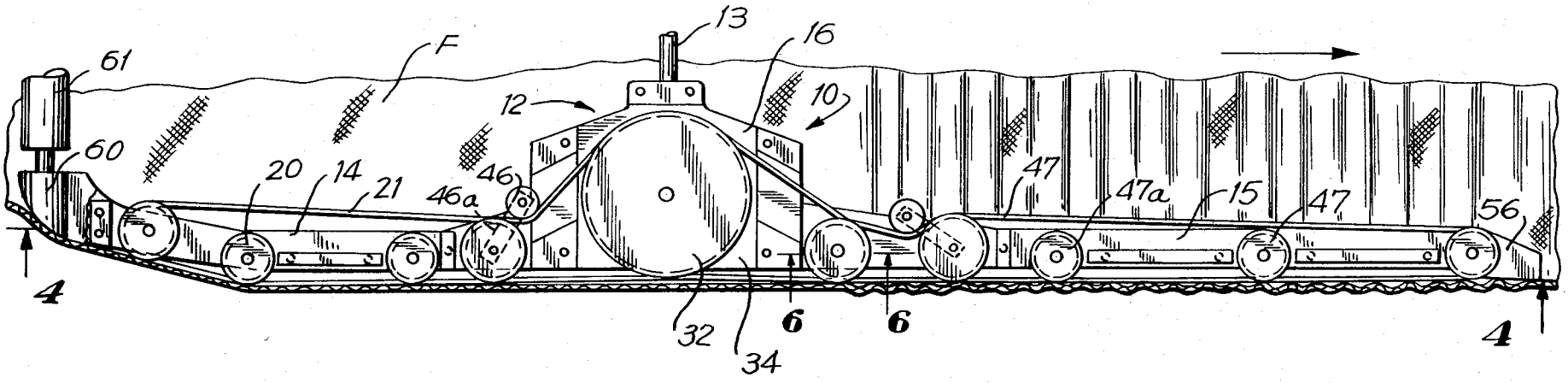
FIG. 3 is an enlarged, fragmentary cross sectional view as taken generally on line 3—3 of FIG. 2, illustrating structural details of the spreader frame apparatus.
Figure 4:
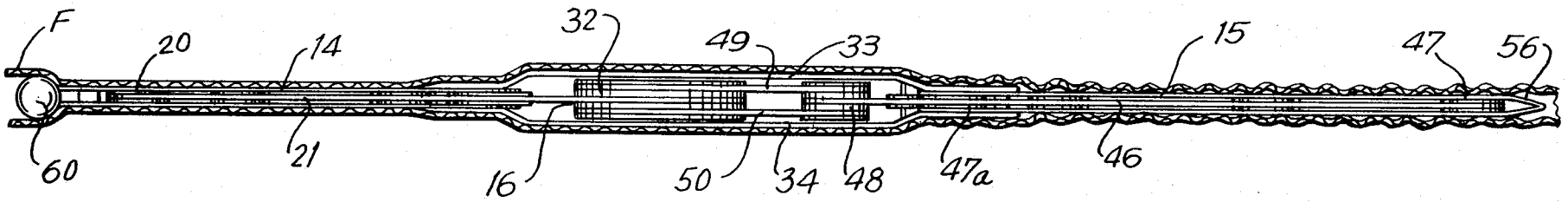
FIG. 4 is a cross sectional view as taken generally on line 4—4 of FIG. 3.
Figures 5, 6:
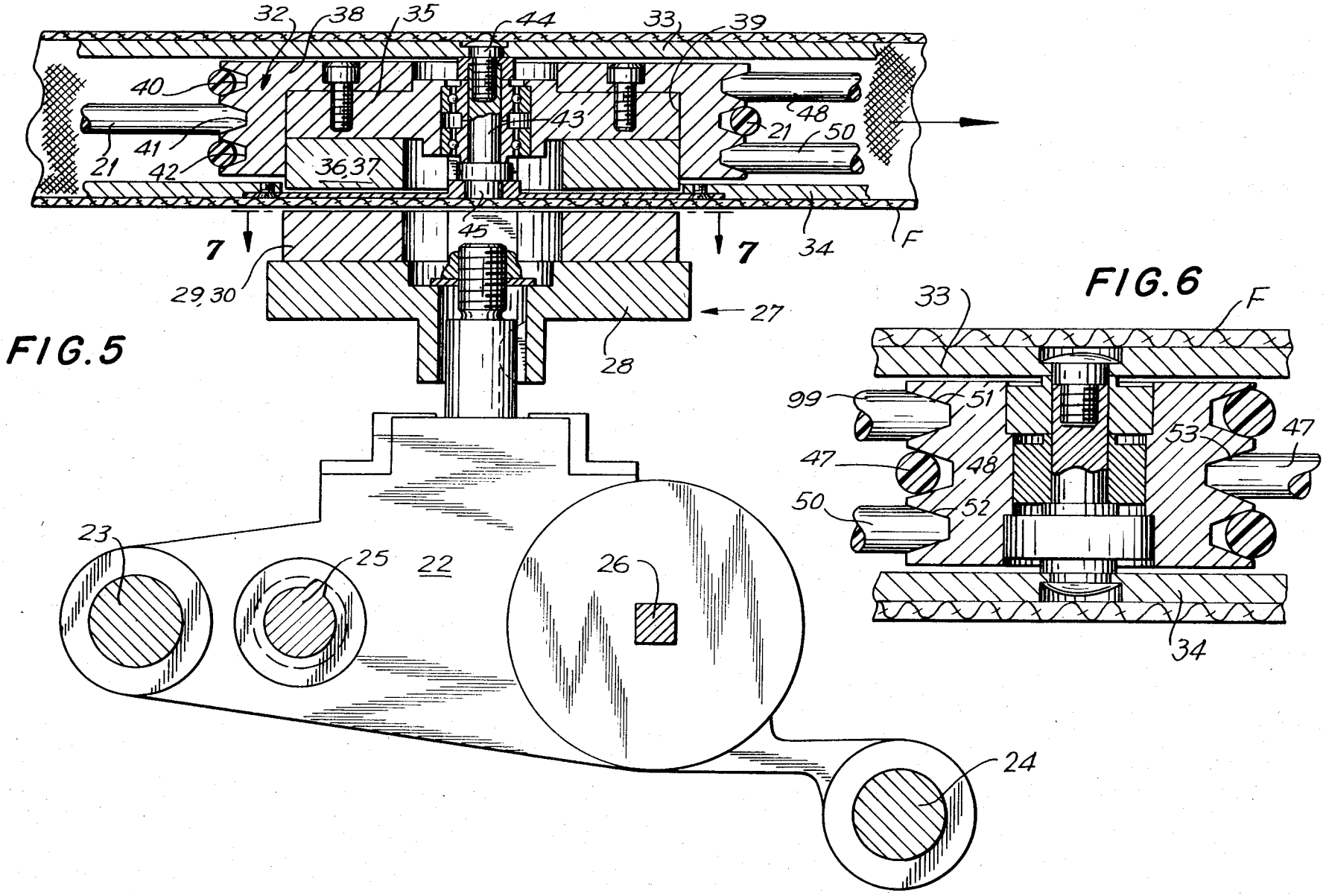
FIG. 5 is an enlarged, cross sectional view as taken generally on line 5—5 of FIG. 1.
FIG. 6 is an enlarged, fragmentary cross sectional view as taken generally on line 6—6 of FIG. 3.

Referring now to the drawing, the reference numeral 10 designates in a general way a spreader frame for receiving tubular knitted fabric F, distending the same to generally flat, two-layer form at a uniform, predetermined width. The frame 10 comprises a pair of laterally spaced, opposed frame sections 11, 12 connected at the respective center regions by means of a spacer bar 13. The spacer bar 13 may be either adjustable in length or readily exchangable for a different spreader bar of another length, to provide for ready width adjustability of the spreader frame 10 as a whole. In some cases the spacer bar 13 may be in the form of a force-biased telecopically extendable element, such as a gas spring unit, for example, enabling width adjustment of the spreader to be accomplished entirely externally of the spreader frame unit. In this respect, it will be understood that, when the unit is in operation, it is completely enclosed within a tubular section of knitted fabric, which is being progressively advanced over the spreader, making the spreader frame physically inacessible.

Each of the spreader frame sections 11, 12 is comprised of an elongated, upstream frame section 14, an elongated downstream frame section 15 and a laterally enlarged central section 16. The spacer ar 13 typically extends between the respective central portions of the frame sections 11, 12, as illustrated in the drawings. Where necessary or desirable, additional connecting elements may be provided, to extend between the respective frame sections at their upstream and downstream extremities, although quite typically it is adequate to space the frame sections principally, if not exclusively, from the center sections thereof.

Desirably, the spreader frame 10 is disposed in a generally horizontal plane. To this end, there is provided a support structure, generally designated by the numeral 17. Included in this support structure is a pair of spaced, transversely extending support rollers 18, 19. These are mounted in the support structure 17 for rotation about parallel, transverse axes, such that the respective support rollers define a common, generally horizontal support plane upon which the spreader frame assembly 10 is supported. Typically and desirably, as will be more evident hereinafter, the support rollers 18, 19 constitute the exclusive support means for the spreader frame during normal operations. To advantage, they are provided with a non-metallic covering (not specifically shown), to avoid metal-to-metal contact when no fabric is present on the spreader, and also for better traction.

The respective upstream frame sections 14 are provided with a plurality of idler sheaves 20 entraining upstream propeller belts 21. In this respect, the upstream frame sections 14 are relatively elongated in the upstream-downstream direction, relatively narrow in the width direction and relatively thin in the vertical direction. The respective idler sheaves 20 support and position the upstream propeller belts to travel along an external path slightly outside of the extremities of the frame sections 14, whereby a section of tubular fabric F, positioned over the spaced upstream frame sections 14, is engaged at its internal edges by the upstream propeller belts 21 and can be conveyed in a downstream direction by advancement of the belts, all in a generally well known fashion.

In the past, typical arrangements for driving the propeller belts have involved the use of external, power driven edge-contacting rolls. In the apparatus of the present invention, as in the before mentioned Johnson U.S. Pat. No. 2,507,599, the upstream propeller belts 21 are driven by means of a magnetically coupled drive arrangement. Pursuant to the present invention, the magnetically coupled drive arrangement includes a pair of drive carriages 22 mounted for simultaneous inward or outward lateral or width adjustment, by means of slide rods 23, 24 and controlled by means of a transversely disposed threaded shaft 25, threaded oppositely at each side such that rotation of the shaft in a given direction will move he respective drive carriages 22 simultaneously inward or outward toward or away from the center line of the machine. A splined drive shaft 26 extends transversely across the machine, having sliding engagement with the drive carriages 22, and is arranged to impart rotational driving to components of the carriages 22 in all adjusted positions thereof.

Mounted on each of the drive carriages 22, and synchronously rotatable thereby, are drive discs, generally designated by the reference numeral 27 (see FIG. 7), each including a support disc 28 of ferromagnetic material mounting a segmented circular array of permanent magnet elements 29, 30. Significantly, the magnetic segments 29, 30 are of an extremely high coercive force material, such as the so-called rare earth magnets sold by Indiana General Magnetic Products, Valparaiso, Ind., under its trademark "INCOR". In one advantageous form of the invention, the magnetizable drive discs 28 are approximately 5½ inches in diameter and mount Incor 21 sections of opposite polarity on each 45° segment. Desirably, the magnetic sectors 29, 30 are of trapezoidal shape, so as to be arrangable in tight fitting, edge to edge contact on the flat upper surfaces of the drive discs 28. Typically, the radial dimension of the magnet sectors may be approximately 36 mm, with a thickness dimension on the order of 18 mm. Desirably, the magnetic sectors are protected from physical and environmental abuse, and this can be achieved effectively by providing a thin, non-magnetic (e.g. plastic) covering 31 over the entire drive disc assembly.

As reflected particularly in FIG. 2, the respective drive disc assemblies 27 are positioned between the transverse support rollers 18, 19, with the upper surfaces of the drive disc assemblies positioned just slightly below the horizontal plane defined by the upper surfaces of the support rollers. This arrangement accommodates highly efficient magnetic coupling with a driven magnetic element, to be described, carried by the spreader frame assembly 10.

In the apparatus of the invention, the respective spreader frame sections 11, 12 mount, in their center sections 16 relatively large diameter internal drive sheaves 32. These sheaves are enclosed within and rotatably supported by broad flat upper and lower central frame plate sections 33, 34. These frame plate sections are of sufficient width (transverse of the main axis of the machine) and sufficient length to completely enclose the internal drive sheaves 32. Importantly, the substantial width of the frame plates 33, 34, necessary in the immediate region of the drive sheaves in order to enclose them, is carried for a distance upstream and downstream of the sheaves, sufficient to extend the wide portions of the frame plates over the tops of the respective support rollers 18, 19 such that, when the frame assembly 10 is in its normal operating position, the spreader frame assembly is supported over a relatively broad area, as a result of the wide frame plate sections 34 which directly overlie the support rollers.

Advantageously, the internal drive sheaves 32 comprise ferromagnetic discs 35, similar to the discs 28, on which are mounted magnetic sectors 36, 37 arranged in a segmented circular array, substantially as the magnetic sectors 29, 30 previously described. Mounted over and in surrounding relation to the assembly of the ferromagnetic disc and magnetic sectors is a sheave-forming shell 38, which is provided with an internal cavity 39 for the reception of the assembly of magnetic disc and magnetic elements 35–37 and has an external peripheral surface forming a plurality (advantageously three) of belt-receiving grooves 40–42. A vertical support shaft 43, is mounted at its upper and lower extremities 44, 45 in the upper and lower central frame plate sections 33, 34. Desirably, at least the lower frame plate section 34 is relatively thin in the region of the sheave 32, so as to accommodate optimum magnetic coupling between the externally driven magnetic elements 27 and the internal sheave assemblies 32. However, the dimensions have not proven to be highly critical.

In the illustrated arrangement, the upstream propeller belts 21 are trained around and driven by the central belt groove 41. A combination guide and tensioning sheave 46, mounted on a lever **46*a*, is provided for each of the upstream belts 21** to assure positive drive of the belts.

Drive means "symbolically shown at 9 in FIG. 1" are provided for driving both the magnetic drive sheaves 27 and the support rollers 18, 19 in such synchronism that the fabric is advanced by the belts 21 at a speed equal to the surface speed of the support rollers.

In many but by no means all cases it is desirable to provide for overfeeding of the fabric on the downstream portion of a spreader frame, to enable the fabric to adjust in length in compensation for the lateral distention of the fabric in passing over the body of the spreader. In this respect, the length and width dimensions of a knitted fabric are interdependent, and lateral distention of the fabric tube is always accompanied by a decrease in length, and vice versa. Accordingly, at least where a relatively substantial amount of lateral distention is being imposed upon the fabric, it usually is desirable to provide for overfeeding.

Where overfeeding of the fabric is desired, it is particularly desirable to cause commencement of the overfeeding to occur at some point downstream of the second or downstream primary support roller 19. In this respect, as fabric is passing over the spreader frame 10, it is moving between the support rollers 18, 19 and the lower central frame plate sections 34. Should the fabric be permitted to gather in advance of the last support roller 19, by for example commencing overfeeding as soon as fabric passed the main internal drive sheave, the gathered fabric might well be pleated and folded in passing over the downstream support roller 19. Accordingly, in the apparatus of the invention, first and second sets of downstream propeller belts are provided, the first set serving to transfer the fabric without overfeeding to a point downstream of the support roller 19, and the second set of belts serving to convey the fabric further downstream at a predetermined lesser rate of speed, causing overfeeding of the fabric to occur at the point of transfer of the fabric from the first set of belts to the second.

With reference to FIG. 3 of the drawing, the downstream frame sections 15 typically are relatively elongated in the downstream direction and relatively narrow in relation to the width of the enlarged center section 16. At the downstream extremity of the center plate structure 16, there is journaled a multiple groove idler sheave 48, having grooves corresponding to those of the internal drive sheave 32. The multigroove idler 48 is journaled at a position at least slightly downstream of the location of the downstream support roller 19, when the frame assembly is properly positioned over the support structure. Immediately downstream of that location, the downstream frame sections 15 are secured to the center plate sections 16.

In the illustrated structure, the idler sheaver 48 is driven by a pair of belts 49, 50 trained in the upper and lower grooves 51, 52 of the multi groove idler. The downstream set of fabric propelling belts 47 are trained in the center groove 53 of the multi groove idler and thus are driven directly from the main internal drive sheave 32. In accordance with known principles, the depth of the center groove 53 is somewhat greater than the depth of the grooves 51, 52 such that, for a given rotation of the multi groove idler 48, the downstream propeller belts 47 will be advanced a linear distance which is slightly less than the linear travel of the driving belts 49, 50. As a result, as fabric is transferred from the belts 49, 50 to the downstream belts 47, there is predetermined accumulation or overfeeding of the fabric to accommodate lengthwise relaxation.

In normal utilization of the propeller-spreader apparatus, the downstream section of the spreader frame extends between a pair of steam boxes 54, 55, and the discharge end extremity 56 projects partly into the nip of a pair of calender rolls 57, 58. To this end, the end extremity 56 typically is tapered to a relatively narrow dimension to avoid interference with the rolls.

Desirably, in accordance with the invention, the spreader frame apparatus is supported in the overall machine assembly exclusively by the driven supprot rollers 18, 19. When the spreader frame is positioned over the support rollers, there is a very strong magnetic attraction attending to draw the internal drive sheaves 32 toward the magnetic drive disc assemblies 27. This provides a rigid platform of support for the spreader frame apparatus, with the longitudinally projecting upstream and downstream frame sections being supported in cantilever fashion from such platform. As long as the external forces acting on the fabric are not excessive, the forces of magnetic attraction of the drive means are sufficient to maintain the spreader frame apparatus in its desired operating position, both in the upstream/downstream direction and widthwise as well.

For normal operation, of course, the respective drive carriages 22 are adjusted laterally such that the main drive disc assemblies 27 are axially aligned with the internal drive sheaves 32, to provide optimum magnetic coupling. Further, in this respect, for the processing of relatively lightweight fabrics and/or where a relatively minor amount of lateral distention is to be applied, the magnetic attraction of the drive discs and internal sheaves may in some cases be relied upon to adjustably position the respective opposite side frame section 11 and 12 in the widthwise direction, utilizing the spacer bar 13 merely to provide telescopic association and alignment. In such cases, it usually will be desirable to provide for biasing of the frame sections 11, 12 in the expanding direction, to help overcome the oppositely directed forces applied by the distended fabric. To this end, a gas spring spacer bar arrangement of the type generally reflected in the Robert Frezza U.S. Pat. No. 4,192,045, assigned to Samcoe Holding Corp., could be useful.

Although the spreader frame apparatus normally is self-positioning, exclusively by magnetic attraction in conjunction with the spaced support rollers 18, 19, it is desirable to provide appropriate safety provisions, in the event extraordinary external forces are applied to the spreader frame as might happen when, for example, the incoming fabric tube were highly twisted, or the fabric became jammed at the supply source. In the first case, the spreader frame may tend to displace in the downstream direction, under the pulling influence of the calender rolls. In the other instance, the spreader frame may tend to displace in the upstream direction, under the pulling force of the internal spreader belts (the displacement, in the latter case, would be relatively limited, however, as it would inherently break or reduce the magnetic coupling to the point that the propeller belts soon would be unable to overcome the resisting force on the fabric).

One form of safety device is illustrated in FIGS. 1 and 2. The upstream extremity of the spreader frame is provided with an enlargement 60, and typically a correspondingly enlarged upstream spacer element 61. In cooperation with the enlarged portions 60, 61, there is provided a pair of stop bars or rollers 62, 63 which extend respectively above and below the upstream portion of the spreader frame. The spacing between the spreader bars is greater than the thickness of the spreader frame proper, but less than the thickness of the enlarged elements 60, 61, and the stop bars are positioned closely adjacent to but downstream of the enlarged portions. Accordingly, during normal operation of the equipment, there is little if any contact between the fabric and the stop bars, and in any event no pressure contact. However, if the spreader frame is physically displaced by external forces, the stop bars will be engaged by the enlarged portions, so that the spreader cannot be drawn into the calender rolls.

For installation and removal of the spreader frame, the upper stop bar 62 is mounted on swing levers 64, which can be pivoted upward to provide an enlarged gap for spreader frame installation. The swing bars are locked by pins 65 in their normal, relatively closely spaced positions, when the equipment is in normal operation.

In conjunction with the stop bars 62, 63, or in place thereof, it is appropriate to provide switch means (not shown) for disabling the equipment drive system, in the event of an excessive displacement of the spreader frame assembly relative to the support structure.

The apparatus of the invention represents a significant improvement over previous attempts to utilize magnetic drive means for spreader-propeller apparatus. In particular, the utilization of across-the-width support rollers, defining a support plane for the spreader frame apparatus, in conjunction with synchronously rotating magnetic drive discs recessed between the support rollers, provides a uniquely advantageous mechanical arrangement for the magnetic drive system. The internal magnetic sheaves, carried within the spreader frame structure, are housed within a relatively wide central plate structure, the upstream and downstream end extremities of which are supported directly over the driven support rollers. The substantial width of the central frame plates, required by the necessarily relatively large diameter of the internal drive sheaves, is carried longitudinally to the areas overlying the support rollers. Accordingly, the total support area provided is substantially greater than has been accommodated by known constructions, and a unit pressure applied to the fabric is thus sufficiently low to avoid marking. In particular, all contact with the edges of the fabric, where relatively high unit pressures are difficult to avoid in a spreader frame of relatively flat, planar construction, is eliminated.

In the arrangement of the invention, the spaced supporting rollers 18, 19 define a support plane for the spreader frame assembly, and the assembly is held on such support plane by the magnetic attraction between the external magnetic drive discs and the internal magnetic drive sheaves. The segmented circular array of rare earth magnet elements, as used in the structure of the invention, provide such a highly effective magnetic coupling that positioning of the spreader frame assembly is provided exclusively by the combination of support rollers and magnetic means. Neither widthwise nor longitudinal positioning by external elements is required. As a result, fabric being processed over the new spreader-propeller apparatus is subjected to an absolute minimum of contact by external means during the spreading phase, and unit pressures on the fabric are reduced to a practical minimum, such that marking of the fabric is effectively avoided. The apparatus of the invention thus makes it possible to process a much broader spectrum of fabrics than has been possible heretofore, particularly sensitive outerwear fabrics of relatively darker shades.

It should be understood, of course, that the specific form of the invention herein illustrated and described is intended to be representative only, as certain changes may be made therein without departing from the clear teaching of the disclosure. Accordingly, reference should be made to the following appended claims in determining the full scope of the invention.

I claim:

1. A magnetically driven spreader apparatus for processing tubular knitted fabrics, which comprises (a) spreader frame assembly including a pair of laterally spaced spreader frame elements, (b) means for maintaining said spreader frame elements in a predetermined spaced relation for distending the tubular knitted fabric to a predetermined uniform width, (c) each of said spreader frame elements having at least one longitudinally extending propeller belt for driving engagement with internal edges of said tubular knitted fabric, (d) magnetic internal drive sheave means carried by said spreader frame assembly for driving at least certain of said propeller belts, (e) said spreader frame assembly defining a wide, flat generally two-sided planar structure for maintaining said fabric in flat, two layer form, (f) a spreader frame support structure, (g) rotatable magnetic drive means mounted in said support structure and magnetically coupled with said internal drive sheave means, (h) adjustable support means for said magnetic drive means for effecting inward and outward lateral width adjustment thereof relative to said spreader frame support structure, (i) movable support means mounted in said support structure, defining a support plane for said spreader frame apparatus and supporting said spreader frame apparatus on a flat side thereof, (j) said magnetic drive means being mounted on the same side of said spreader frame elements as said movable support means, (k) means for synchronously driving said movable support means and said magnetic drive means, (l) said spreader frame assembly and said spreader frame support structure being cooperatively effective to maintain the edge extremities of a fabric, moving over said spreader frame assembly, free of significant external pressure.

2. A spreader apparatus according to claim 1, further characterized by (a) said movable support means supporting said spreader frame assembly on upstream and downstream sides of said rotatable magnetic drive means, and (b) said movable support means constituting the sole means of support of said spreader frame assembly.

3. A spreader apparatus according to claim 2, further characterized by (a) said movable support means comprising spaced, transversely disposed support roller means supporting a flat side of said spreader frame assembly.

4. A spreader apparatus according to claim 3, further characterized by (a) said transversely disposed support roller means extending across the full width of said spreader frame assembly, and (b) said spreader frame assembly being, in normal operation, free of physical restraint in the upstream-downstream directions and in the width directions.

5. A spreader apparatus according to claim 4, further characterized by (a) safety stop means mounted on said support structure and normally out of contact with said spreader frame assembly, (b) said safety stop means being engageable with said spreader frame assembly upon predetermined displacement thereof from a normal position.

6. A spreader apparatus according to claim 5, further characterized by (a) said safety stop means including an enlarged stop member on said spreader frame means located upstream of the movable support means, and (b) said safety stop means including means on said support structure embracing said spreader frame assembly in non-contacting relation and operative to block passage of said enlarged stop member upon predetermined displacement of said spreader frame assembly.

7. A magnetically driven spreader apparatus for processing tubular knitted fabrics, which comprises (a) a pair of laterally spaced spreader frame elements, (b) means for maintaining said spreader frame elements in a predetermined spaced relation for distending the tubular knitted fabric to a predetermined uniform width, (c) each of said spreader frame elements having at least one longitudinally extending propeller belt for driving engagement with internal edges of said tubular knitted fabric, (d) an internal drive sheave carried by each spreader frame element for driving a propeller belt, (e) said spreader frame elements defining a wide, flat generally planar structure for maintaining said fabric in flat, two layer form, (f) a spreader frame support structure, (g) rotatable magnetic drive elements mounted in said support structure and magnetically coupled with said internal drive sheaves, (h) adjustable support means for said magnetic drive elements for effecting inward and outward lateral width adjustment thereof relative to said spreader frame support structure, (i) a pair of spaced parallel transversely extending support rollers mounted in said support structure and defining a support plane for said spreader frame, (j) said magnetic drive elements being mounted between said support rollers and on the same side of said spreader frame elements as said support rollers, (k) means for synchronously driving said support rollers and said magnetic drive elements, (l) said spreader frame assembly and said spreader frame support structure being cooperatively effective to maintain the edge extremities of a fabric, moving over said spreader frame assembly, free of significant external pressure.

8. The spreader apparatus of claim 7, further characterized by (a) each of said spreader frame elements having at least two belts, (b) said belts being arranged to provide a pair of upstream belts and a pair of downstream belts, (c) common sheave means interconnecting the respective upstream and downstream belts for driving said downstream belts at a relatively lower rate of speed than said upstream belts to provide for overfeeding of the fabric, (d) said common sheave means being located downstream of said internal drive sheaves and in such position relative to said transverse support rollers that said overfeeding commences downstream of said rollers.

9. The spreader apparatus of claim 7, further characterized by (a) said spreader frame elements including lower frame plate elements located immediately adjacent said internal drive sheaves respectively on the upstream and downstream sides thereof, said frame plate elements being positioned over and being supported by said transversely extending support rollers, (b) said frame plate members having a width dimension, in the direction of the axis of said support rollers, which is substantially greater than the width of the balance of the frame elements extending upstream and downstream from said plate members, providing supporting contact with said rollers over a substantial distance.

10. A spreader apparatus according to claim 7, further characterized by (a) said internal drive sheaves comprising a plurality of permanent magnet segments, arranged in a segmented, circular array of opposing polarities, and (b) said rotatable magnetic drive elements comprising similar permanent magnetic elements, arranged in a substantially similar circular segmented array and positioned to have face to face magnetic coupling with said internal drive sheaves.

* * * * *